US007182376B2

(12) United States Patent
Maginness

(10) Patent No.: US 7,182,376 B2
(45) Date of Patent: Feb. 27, 2007

(54) CONTAINER FOR COLLECTING AND DISPOSING OF ANIMAL EXCRETA

(75) Inventor: Joseph Gabriel Maginness, Belfast (GB)

(73) Assignee: Waterfall NI Ltd (No. NI045258), Northern Ireland (GB)

( * ) Notice: Subject to any disclaimer, the term of this patent is extended or adjusted under 35 U.S.C. 154(b) by 22 days.

(21) Appl. No.: 10/516,791

(22) PCT Filed: Jun. 9, 2003

(86) PCT No.: PCT/GB03/02505

§ 371 (c)(1),
(2), (4) Date: Dec. 3, 2004

(87) PCT Pub. No.: WO03/104569

PCT Pub. Date: Dec. 18, 2003

(65) Prior Publication Data

US 2005/0236851 A1 Oct. 27, 2005

(30) Foreign Application Priority Data

Jun. 7, 2002 (GB) ..... 0213539.0
Nov. 1, 2002 (GB) ..... 0225481.1

(51) Int. Cl.
*A01K 29/00* (2006.01)
*E01H 1/12* (2006.01)

(52) U.S. Cl. ..... 294/1.3

(58) Field of Classification Search ..... 294/1.1, 294/1.3, 1.4; 15/257.1; 119/161, 171
See application file for complete search history.

(56) References Cited

U.S. PATENT DOCUMENTS 3,611,744 A * 10/1971 Sutz ..... 62/263
3,680,504 A 8/1972 Seebald
3,718,358 A * 2/1973 Ayers ..... 294/1.4
3,740,086 A 6/1973 Rossitto
4,286,816 A * 9/1981 Tobias ..... 294/1.4
4,422,681 A 12/1983 Laroche
4,744,380 A * 5/1988 Sheriff ..... 134/198

FOREIGN PATENT DOCUMENTS

DE 3238062 A1 4/1984
DE 36 06 468 9/1987

(Continued)

OTHER PUBLICATIONS

International Search Report, dated Jul. 18, 1989 for PCT/GB89/00295, total p. 2.

*Primary Examiner*—Dean J. Kramer
(74) *Attorney, Agent, or Firm*—Ostrolenk, Faber, Gerb & Soffen, LLP

(57) ABSTRACT

A hand-held portable container (1) for collecting and disposing of animal excreta comprising a shell (5,101) having an opening for receiving excreta, the shell (5,101) having an impaling instrument including a plurality of tines (8) disposed within the shell (5,101) for impaling excreta. The tines (8) are provided by teeth (105) tapered so that the edges of the teeth (105) closet to the opening of the shell (5,101) are thin enough to allow at least partial penetration of excreta received into the opening. An aerosol cartridge (4,136) is mounted in a housing (3,131) of the container (1) and the cartridge includes a freezing component for freezing the excreta to the tines of the shell.

16 Claims, 7 Drawing Sheets

FOREIGN PATENT DOCUMENTS

| | | | | | |
|---|---|---|---|---|---|
| DE | 298 16 807 U1 | | 5/1999 | | |
| EP | 0 107 602 B1 | | 5/1984 | | |
| FR | 2 533 466 A1 | | 3/1984 | | |
| FR | 2 554 841 A3 | | 5/1985 | | |
| FR | 2 597 130 A1 | | 10/1987 | | |
| FR | 2620-745 | * | 3/1989 | ..... | 294/1.3 |
| WO | WO 89/08744 | | 9/1989 | | |

* cited by examiner

CONTAINER FOR COLLECTING AND DISPOSING OF ANIMAL EXCRETA

This invention relates to a container for collecting and disposing of animal excreta and in particular to a hand held apparatus for collecting dog's excreta.

Various cities and towns throughout the world have introduced legislation making it a public offense for a dog owner to allow a dog to foul the pavements or public parks without removing the excreta thereafter. An apprehended person walking the animal is often subject to a fixed penalty fine. In any event, this is an unhygienic practice particularly in parks or areas where children are prone to be playing. The impact of both the deterrent of a fine and increased public awareness in relation to hygiene has produced a need for an apparatus to remove excreta from pavements, grass and other surfaces upon which a dog excretes during exercise or during any other time spent outdoors.

A variety of apparatuses have been developed to assist pet owners with the task of removing excreta from a surface shortly after it has been deposited by a pet.

WO 89/08744 discloses a refuse collector having a receiver for the refuse and a vacuum cleaner unit for collecting the refuse and transmitting it to the receiver. A source of refrigerant gas is provided to be directed onto the refuse to partly freeze it before it is collected and transmitted to the receiver.

DE 3238062 discloses a container in which a cooling medium is accommodated to harden the surface of domestic animal faces making it easier to lift and carry. The container is designed for both lifting and storing the faces of the domestic animal.

DE 29816807 discloses a device having a portable container with a cold spray enabling the dog excrement to be cooled before collection and disposal. The device enables the excrement to acquire a firm consistency prior to collection and disposal.

The present invention provides an alternative construction of container for collecting and disposing of excreta deposited by a pet/domestic animal.

Accordingly, there is provided a hand-held portable container for collecting and disposing of animal excreta comprising a shell having an opening for receiving excreta, the shell having an impaling means including a plurality of tines disposed within the shell for impaling excreta. The plurality of tines cause minimal dispersion of the excreta when an operator presses the tines down into it. The tines increase the surface area of the container which comes into contact with the excreta increasing the likelihood of a successful removal of all of the excreta from the surface it has been deposited on.

Preferably, the tines are provided by teeth tapered so that the edges of the teeth closest to the opening of the shell are thin enough to allow at least partial penetration of excreta received into the opening.

Ideally, the teeth extend radially inwardly from the shell.

Preferably, the teeth are symmetrically disposed about the central axis of the shell.

Ideally, the shells are nestable with one another. This reduces the space required for shells during storage, transportation and use.

Ideally, the container comprises a housing having one or more shells releasably mounted thereon.

Preferably, the housing comprises a hollow elongate element for receiving an aerosol cartridge.

Ideally, the one or more shells are releasably mounted on a first end of the housing.

Ideally, the or each shell is held on the first end of the housing by a collet. Alternatively, the shells are held in place by friction.

Preferably, the shell has a flared open end. This allows the shell to receive excreta of varying size and forms.

Ideally, the aerosol includes a freezing component for freezing at least the outer skin of the excreta. This improves the bond between the tines and the excreta increasing the likelihood of a successful removal of the excreta, at the first attempt.

Preferably, the housing comprises two identical semi-cylindrical plastics mouldings. This reduces the manufacturing costs of the housing.

Preferably, a second end of the housing accommodates means for actuating an aerosol cartridge so that a predetermined portion of aerosol is dispensed.

Ideally, the actuating means comprises a button housed in the second end of the housing and being depressible so as to dispense aerosol from the aerosol cartridge.

Preferably, the button has a predetermined travel so that a desired quantity of aerosol is dispensed when the button is depressed along the full distance of its travel.

Ideally, the second end of the housing defines a slot and the button has a flange housed within the slot so that the travel of the button is delimited by the width of the slot.

Preferably, the button is normally urged out of the housing by the biasing means on a nozzle of the cartridge.

Ideally, the travel of the button is selected to accommodate a wide range of aerosol cartridges.

Preferably, the surface of the button in contact with the aerosol cartridge is substantially hemispherical.

Preferably, an outer surface of the housing for receiving a hand is adapted to increase friction between the users hand and the housing.

Ideally, a rib and groove formation is provided on at least a portion of the outer surface of the housing.

Preferably, means for engaging the nozzle of the aerosol cartridge are provided on the first end of the housing so that a predetermined optimum quantity of aerosol is dispensed when the button is fully depressed once.

Ideally, a seat is provided for supporting the dispensing end of the cartridge.

Preferably, the engagement means depresses the nozzle of the aerosol cartridge in response to the button being depressed so that aerosol is dispensed.

Ideally, a plurality of shells are releasably mounted on the first end of the housing.

Preferably, the shells have an aperture for receiving the aerosol from the cartridge.

Ideally, the aperture is disposed centrally of the shell and is substantially aligned with the dispensing nozzle in use.

Preferably, an upstanding collar is disposed on the outside of the shell surrounding the aperture.

Ideally, the collar is suitably dimensioned for engaging the nozzle of the aerosol cartridge in order to dispense aerosol in response to the button being depressed.

In a first embodiment, the impaling means is integrally formed with the shell.

In a second embodiment, the impaling means is removably mounted on the shell.

In the second embodiment, the impaling means comprises a base located outside the shell and a plurality of tines outstanding therefrom, extending through and disposed within the shell, the shell having a plurality of apertures aligned with the tines for slidable engagement therewith.

In a third embodiment, sharp tines penetrate the shell without the need of apertures. The shell facilitates their cleaning upon withdrawal.

Ideally, the shell comprises a base and a wall outstanding from the periphery of the base.

In a fourth embodiment, the container comprises a housing having one or more shells releasably mounted thereon and a fluid delivery means being mounted on the housing for communicating fluid from an aerosol cartridge mounted on the housing to the area around the fines.

In any embodiment, a lid is provided for engagement with the shell for covering the tines and any excreta impaled thereon prior to disposal. This improves the hygienic aspect of the container.

Preferably, the lid has a covering plate and a flange projecting substantially orthogonally from the plate.

Ideally, the flange extends around the external surface of the shell at or about the shell's free edge to prevent contamination from excreta lodged adjacent to the free edge.

In any embodiment, the shell, lid and tines are formed from plastic.

In any embodiment, the shell and lid are formed from cardboard and the tines are formed from wood.

In the second embodiment, the base of the impaling means is formed from cardboard and the tines are formed from wood.

In the second embodiment, the base of the impaling means and the tines are formed from plastic.

In the second embodiment, the housing is integrally formed with the base of the impaling means on the side of the base opposite the side which carries the tines.

In a fifth embodiment, the housing has a substantially c-shaped resilient clip mounted thereon for receiving the aerosol cartridge.

In the fourth or fifth embodiment, the fluid delivery means comprises a dispensing head for engagement with a nozzle of the aerosol cartridge and a pipe extending between the dispensing head and the area around the tines.

In the fourth or fifth embodiment, the shell defines an aperture for receiving a free end of the pipe.

In the fourth or fifth embodiment, the dispensing head has an annular shoulder formed for engagement with an annular flange on the nozzle to open the aerosol cartridge when an operator presses on the dispensing head allowing aerosol to flow out of the cartridge through the pipe to the area around the tines.

It will of course be appreciated that an elongate handle in the form of a walking stick can extend from the housing, the handle having a means for remotely activating the dispensing head for opening the aerosol cartridge.

Ideally, the free end of the pipe is located centrally of and extends through the aperture in the shell for communicating the aerosol to the area around the tines.

In the second embodiment, the free end of the pipe is located centrally of and extends through the base of the impaling means and the aperture in the shell.

In a sixth embodiment, the shell is releasably mounted on a housing having two main faces, one face carrying a means for fastening an aerosol cartridge thereon and the other face having a surrounding wall outstanding from the periphery thereof defining a cavity for receiving the shell.

In the sixth embodiment, the shell and the cavity are dimensioned to form an interference fit therebetween. This allows the shell to be easily inserted into and removed from the cavity before and after use respectively.

In the sixth embodiment, a screw is provided in a threaded bore extending through the wall outstanding from the face of the housing for engaging the shell housed in the cavity.

In any embodiment of the invention, the wooden or plastic tines are replaced by metal tines having an integrally formed temperature reducing means. The reduced temperature of the metal fines results in freezing of the excreta in the area around the tines and providing a strong bond between the excreta and the tines.

Preferably, a battery-powered light bulb or semi-conductor lamp and a switch are mounted on the housing.

Ideally, transparent glass covers the light bulb to the front of the container and a red glass is provided for transmitting the light at the rear of the container.

Accordingly, the present invention also provides a method of collecting animal excreta comprising the steps of contacting the excreta with a solid body, dispensing aerosol including a freezing component around the excreta and solid body so as to form a bond between the excreta and the solid body and subsequently lifting the solid body so as to remove the excreta from the surface it was deposited on.

The present invention will now be described with reference to the accompanying drawings, which show, by way of example only, two embodiments of an apparatus for collecting and disposing of animal excreta in accordance with the invention.

Figure 1:
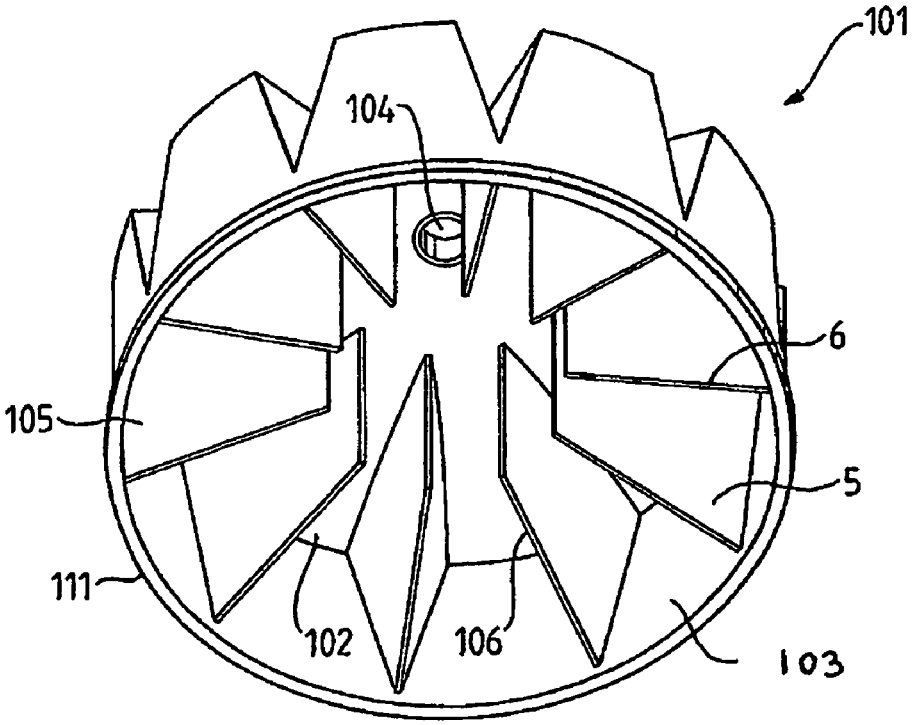
FIG. 1 is an internal perspective view of a shell.

Referring to the drawings and initially to FIG. 1, there is shown a shell indicated generally by the reference numeral 101. The shell 101 has a circular base 102 and a wall 103 upstanding from the base 102. The base 102 has a central aperture 104. Ten tapered teeth 105 are integrally formed with the base 102 and upstanding wall 103. The edges 106 of the teeth 105 closest to the opening of the shell 101 are thin enough to allow penetration of excreta received into the opening. The teeth 105 extend radially inwardly from the base 102 and wall 103 and cover a substantial portion of the space enclosed by the shell 101.

Figure 2:
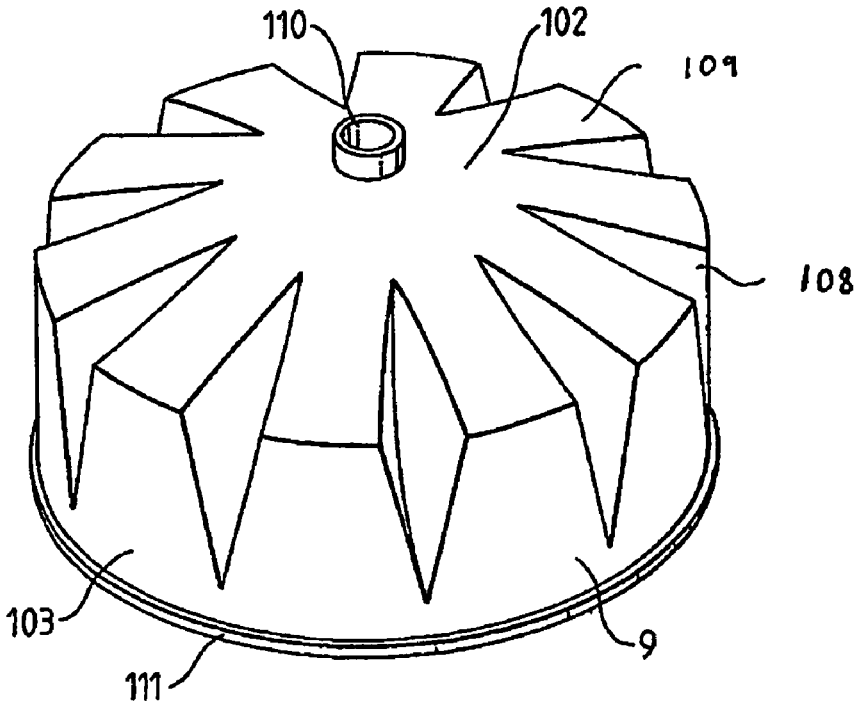
FIG. 2 is an external perspective view of the shell of FIG. 1.

Referring now to FIG. 2, cavities 108 are defined on the external surface 109 of the shell 101 by the radially inwardly extending teeth 105 of FIG. 1. An integrally formed collar 110 upstanding from the base 102 in a direction opposite to the wall 103 encloses the aperture 104. The end of the wall 103 distal from the base 102 defines a minor support rim or flange 111 on the external surface of the wall 103. (See FIGS. 1 and 2).

Figure 3:
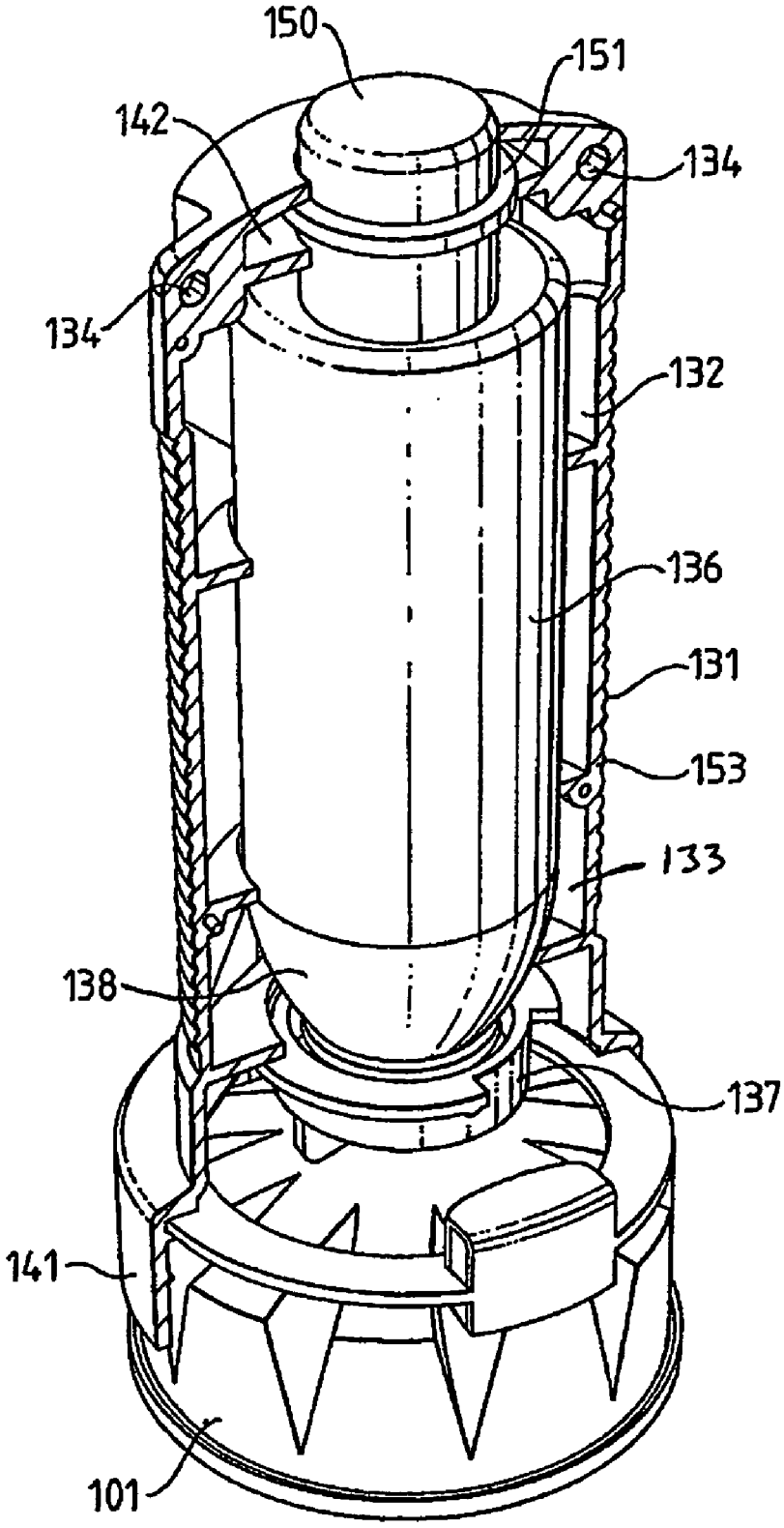
FIG. 3 is a partial cutaway perspective view of a first embodiment of a container.
Figure 5:
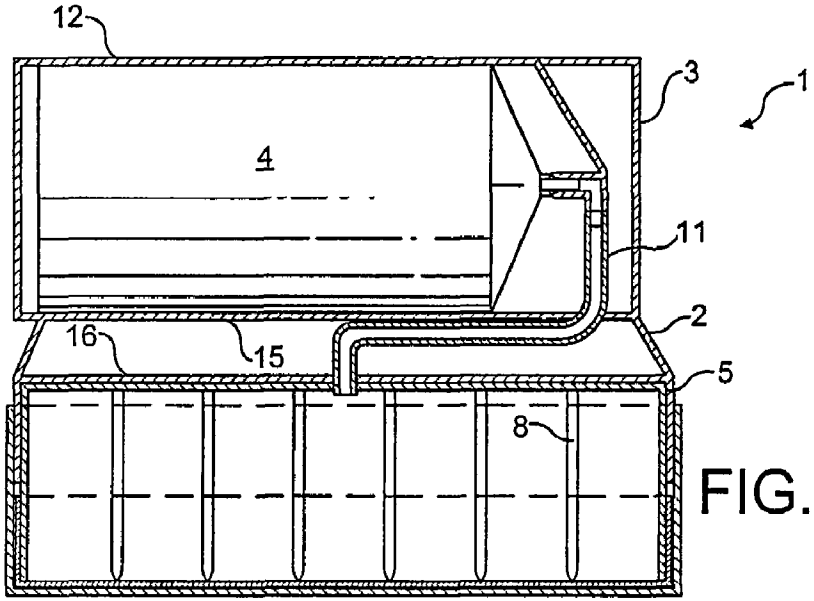
FIG. 5 is a side view of FIG. 4.
Figure 6:
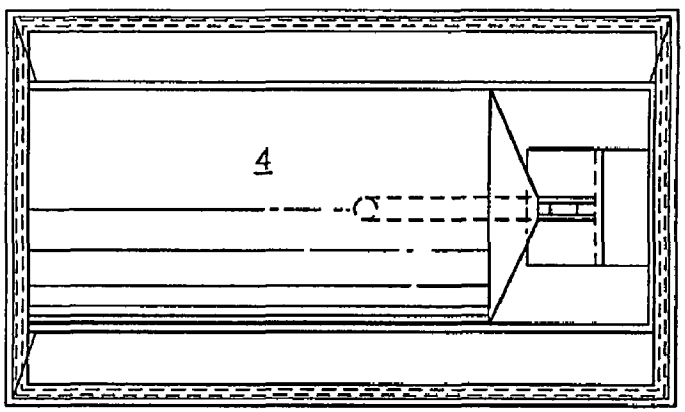
FIG. 6 is a plan view of FIG. 4 and FIG. 5.
Figure 4:
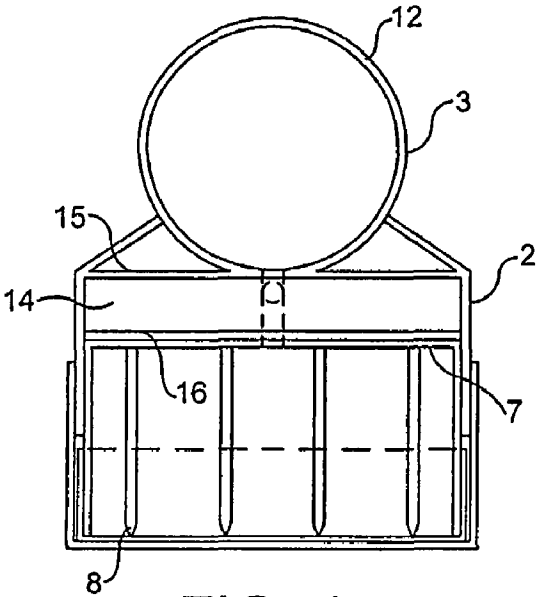
FIG. 4 is an elevation view of a second embodiment of the container.
Figure 8:
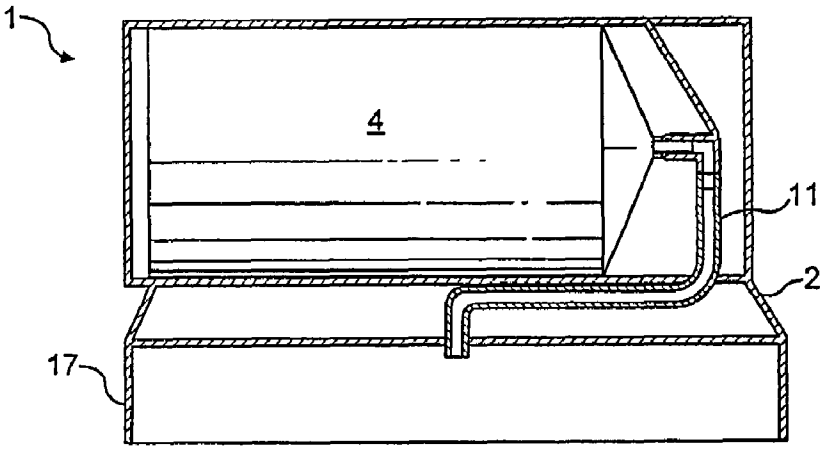
FIG. 8 is side view of FIG. 7.
Figure 9:
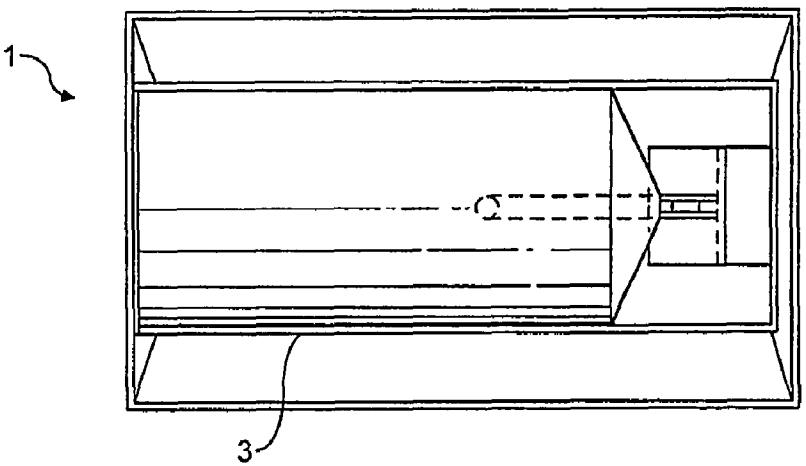
FIG. 9 is a plan view of FIG. 7 and FIG. 8.
Figure 7:
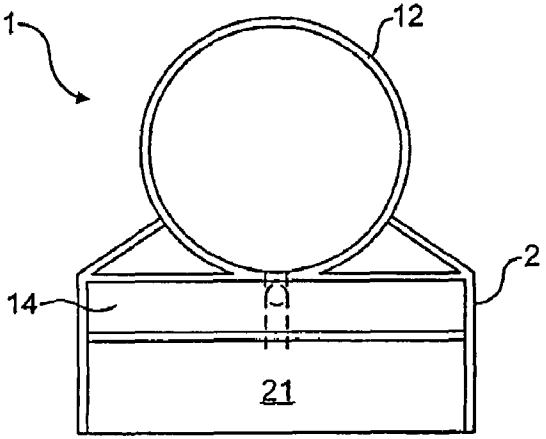
FIG. 7 is an elevation view of the second embodiment of the container with an aerosol cartridge mounted thereon.
Figure 11:
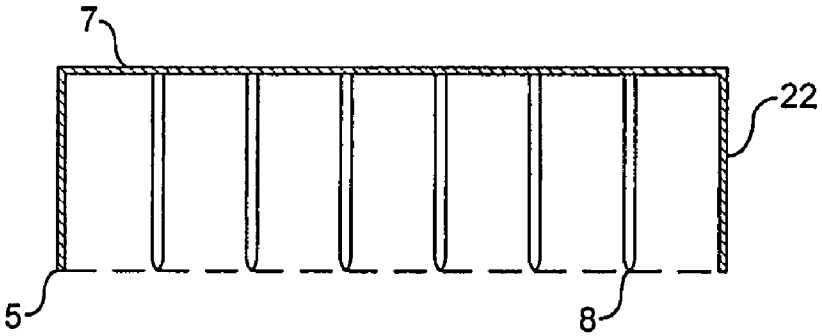
FIG. 11 is a side view of FIG. 10.
Figure 12:
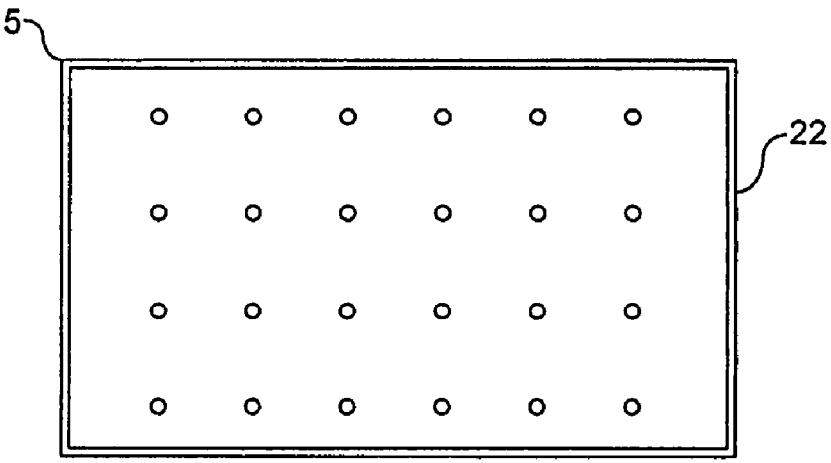
FIG. 12 is a plan view of FIG. 10 and FIG. 11.
Figure 10:
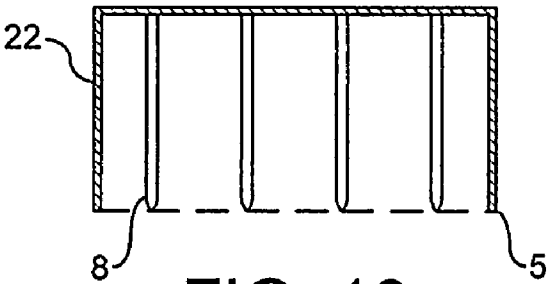
FIG. 10 is an elevation view of a second embodiment of a shell.

Referring to FIG. 3, there is shown the shell 101 of FIGS. 1 and 2 mounted on housing 131. The housing 131 is a hollow elongate element 132.

The element 132 has two identical semi-cylindrical sections 133 (only one shown) fastened together by any suitable fasteners along the split line of the element 132 via bores 134 correspondingly located in each semi-cylindrical section 133. An aerosol cartridge 136 is accommodated within the housing 131 with the end of the cartridge 136 carrying a dispensing nozzle (not shown) juxtaposed the shell 101. A seat 137 is provided on the first end of the housing 131 juxtaposed the shell 101. The seat 137 provided on this end of the housing 131 is for supporting the tapered neck 138 of the cartridge 136. This end also has an abutment element (not shown) for engaging the nozzle (not shown) of the cartridge 136. A collet 141 also extends from this end of the housing 131 for releasably fastening the shell 101 thereon.

The second end of the housing 131 has a slot 142 extending at least partially around the internal surface of the housing 131 perpendicular to the longitudinal axis of the housing 131. A cylindrical button 150 has a peripheral flange 151 and is held in this end of the housing 131 by the peripheral flange 151 which is housed within the slot 142 and movable relative to the slot 142.

The cartridge 136 urges the button 150 out of the housing 131 under normal circumstances due to the biasing force of the biasing element acting on the nozzle of the cartridge 136.

A rib and groove formation 153 is provided on the outer surface of the housing 131.

In use, an operator locates one or more shells 101 onto the first end of the housing 131. In order to collect and dispose of excreta, the operator lowers the housing 131 and shell 101 towards the excreta with the open end of the shell 101 facing the excreta. The edges 106 of the teeth 105 are forced down into the excreta. At this point, the operator presses the button 150 forcing the nozzle of the cartridge 136 to engage the abutment element. This releases a predetermined amount of aerosol through the upstanding collar 110 and aperture 104 into the space in the shell 101 around the impaled excreta. A short period of time is allowed for the frozen excreta to bond with the teeth 105. The operator raises the housing 131 and shell 101 lifting the excreta off the surface it was deposited on. The operator can place a lid on the shell 101 and remove the sealed shell 101 from the housing 131 in order to discard the shell 101 and excreta.

Referring to FIGS. 4 to 9 and FIG. 19, there is shown a container for collecting and disposing of excreta indicated generally by the reference numeral 1. The container 1 has a housing 3 for receiving an aerosol cartridge 4 therein. A shell 5 is releasably mounted on the housing 3, the shell 5 having a base 7 and a plurality of tines 8 outstanding substantially orthogonally from the base 7.

The housing 3 also carries a fluid delivery apparatus 11 for delivering fluid from the aerosol cartridge 4 to the area around the tines 8. The housing 3 has an open-ended tube 12 for receiving an aerosol cartridge 4 manufactured from plastic and integrally formed with a substantially oblong elongate element 14 having the tube 12 extending along one side 15 thereof. The opposite side 16 of the element 14 carries a surrounding wall 17 outstanding therefrom and defining a cavity 21. The cavity 21 is dimensioned for receiving the shell 5 holding it in position by an interference fit therebetween.

Figure 13:
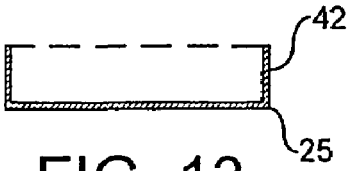
FIG. 13 is an elevation view of a lid for the shell of FIGS. 10 to 12.
Figure 14:
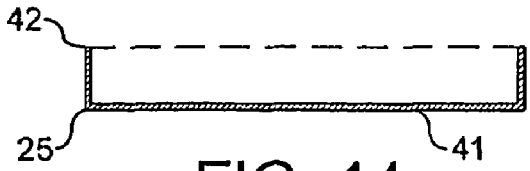
FIG. 14 is a side view of the lid of FIG. 13.
Figure 15:
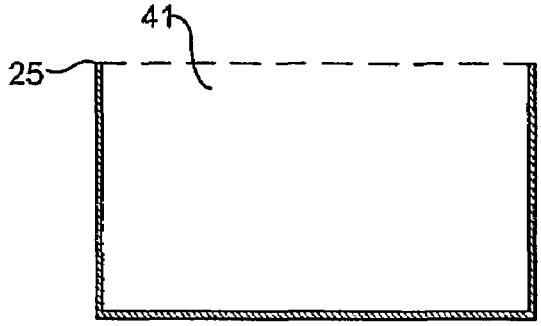
FIG. 15 is a plan view of the lid of FIG. 13 and FIG. 14.
Figure 16:
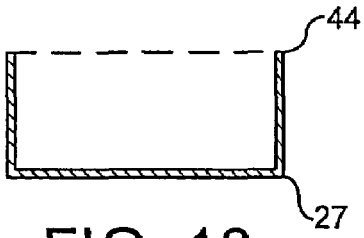
FIG. 16 is an elevation view of a lid for the housing of FIGS. 7 to 9.
Figure 17:
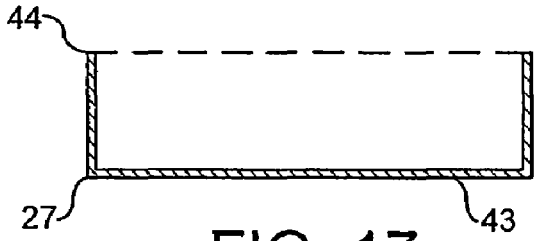
FIG. 17 is a side view of the lid of FIG. 16.
Figure 18:
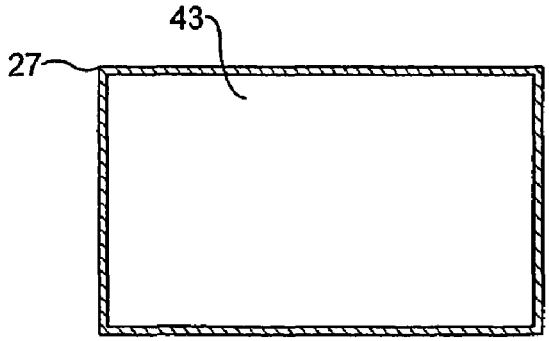
FIG. 18 is a plan view of the lid of FIG. 16 and FIG. 17.
Figure 19:
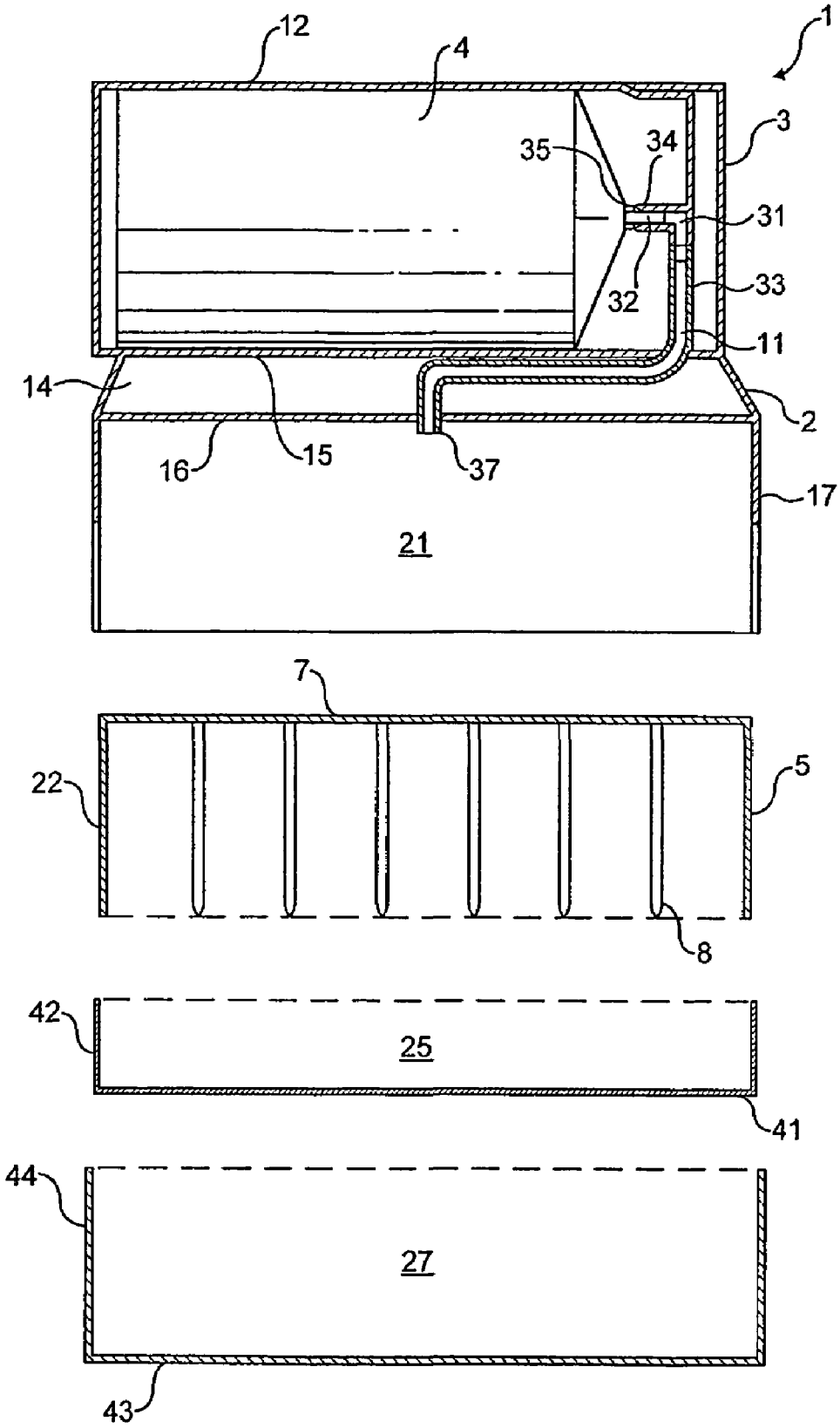
FIG. 19 is an exploded view of the second embodiment of the container.

The shell 5 has a surrounding wall 22 outstanding from the base 7 in the same direction as the tines 8. The base 7 and surrounding wall 22 are formed from cardboard and the tines 8 are formed from wood and are presented as wooden stakes. A lid 25 (see FIGS. 16 to 18) formed for engagement with the outstanding wall 22 of the container 5 is provided to enclose the tines and any matter impaled thereon. The lid 25 has a base 41 and a surrounding wall 42 outstanding from the base 41. A second lid 27 (see FIGS. 13 to 15) formed for engagement with the surrounding wall 17 is also provided with a base 43 and a surrounding wall 44 outstanding from the base 43 and the lid 25 is enclosed by the lid 27 when both lids are mounted on their respective surrounding walls 22, 17. The lid 27 provides further protection against contamination from excreta which adheres to the free edge of the shell 5.

The fluid delivery apparatus 11 (see FIG. 19) has a dispensing head 31 for engagement with the nozzle 32 of the aerosol cartridge 4 and a pipe 33 for transferring the aerosol to the area surrounding the tines 8. The dispensing head 31 has an annular shoulder 34 formed for engagement with an annular flange 35 surrounding the base of the nozzle 32. The free end 37 of the pipe 33 is located centrally of and extends through the base 7 of the shell 5.

Referring to FIGS. 10 to 13, the tines 8 are shown in rows and columns outstanding from the base 7 of the shell 5 forming an array of wooden stakes to penetrate excreta. In this embodiment, the tines 8 extend perpendicularly from the base 7.

In use, a person who is walking a pet which has fouled the walking area takes hold of the container 1 by the housing 3. With the other hand, an operator removes both lids, outer lid 27 and then inner lid 25 exposing the outstanding tines 8. The lids 25, 27 are placed on the ground on their bases 41 and 43 respectively so that the lids can be rejoined to their corresponding parts without lifting them again. The operator now moves the container 1 towards the excreta, tines 8 first. The tines 8 are pressed down into the excreta until the outstanding wall 22 contacts the surface upon which the excreta is supported. The aerosol cartridge 4 is now opened for a few seconds by applying force to the nozzle 32 allowing the aerosol to flow through the pipe 33 and into the area enclosed by the base 7, wall 22 and the surface upon which the excreta is supported.

The freezing component of the aerosol freezes at least the skin of the excreta which bonds to the tines 8 and the core of the excreta. The lifting operation can now be repeated in order to lift additional mounds of excreta. After the first mound has been successfully frozen and lifted, the apparatus can be placed over an additional mound. The inner core of the original mound merges and bonds with the second mound. Parts of the second mound are pierced by the tines and the new combined mound is frozen again. The operator lifts the container 1 away from the support surface and the excreta is removed from the surface. The operator now moves the container 1 into alignment with the lid 25 and lowers the container 1 tines 8 first onto the lid 25 sealing the excreta within the shell 5. The shell 5 may now be detached from the cavity 21 of the container 1 and disposed of in a bin. Alternatively, if no such waste disposal facility is available, the operator can place the main lid 27 onto the container 1 until a suitable bin is located.

Variations and modifications can be made without departing from the scope of the invention described above and as claimed hereinafter.

The invention claimed is:

1. A hand-held portable container (1) comprising a housing (3, 131) having one or more shells (5, 101) releasably mounted thereon, the or each shell (5, 101) having an opening for receiving excreta and having an impaling means including a plurality of tines (8) disposed within the shell (8) for impaling excreta characterised in that the housing (3, 131) has an aerosol cartridge (4, 136) including a freezing component mounted thereon, the or each shell having an aperture for receiving aerosol from the aerosol cartridge.

2. A hand-held portable container (1) as claimed in claim 1, wherein the tines (8) are provided by teeth (105) tapered so that the edges of the teeth (105) closest to the opening of the shell (5, 101) are thin enough to allow at least partial penetration of excreta received into the opening.

3. A hand-held portable container (1) as claimed in claim 2, wherein the teeth (105) extend radially inwardly from the shell (5, 101).

4. A hand-held portable container (1) as claimed in claim 2, wherein the teeth (105) are symmetrically disposed about the central axis of the shell (5, 101).

5. A hand-held portable container (1) as claimed in claim 1, wherein the shells (5, 101) are nestable with one another.

6. A hand-held portable container (1) as claimed in claim 1, wherein one or more shells (5, 101) are held on one end of the housing (3, 131) by a collet (141).

7. A hand-held portable container (1) as claimed in claim 1, wherein the shells (5, 101) are held in place by friction.

8. A hand-held portable container (1) as claimed in claim 1, wherein the shells (5, 101) have a flared open end.

9. A hand-held portable container (1) as claimed in claim 1, wherein the housing (3, 131) comprises two identical semi-cylindrical plastics mouldings (133).

10. A hand-held portable container (1) as claimed in claim 1, wherein a second end of the housing accommodates means for actuating the aerosol cartridge (4, 136) so that a predetermined portion of aerosol is dispensed.

11. A hand-held portable container (1) as claimed in claim 10, wherein the actuating means comprises a button (150) housed in the second end of the housing and being depressible so as to dispense aerosol from the aerosol cartridge (4, 136).

12. A hand-held portable container (1) as claimed in claim 11, wherein the button (150) is normally urged out of the housing (3, 131) by a biasing means on a nozzle of the aerosol cartridge (4, 136).

13. A hand-held portable container (1) as claimed in claim 11, wherein the travel of the button (150) is selected to accommodate a wide range of aerosol cartridges (4, 136).

14. A hand-held portable container (1) as claimed in claim 1, wherein the aperture (104) is disposed centrally of the shell (5, 101) and is substantially aligned with a dispensing nozzle in use.

15. A hand-held portable container (1) as claimed in claim 14, wherein the impaling means is removably mounted on the shell.

16. A hand-held portable container (1) as claimed in claim 15, wherein the impaling means comprises a base located outside the shell and the plurality of tines outstanding therefrom, extending through and disposed within the shell, the shell having a plurality of apertures aligned with the tines for slidable engagement therewith.

* * * * *